US007624898B2

(12) United States Patent
Hornsby et al.

(10) Patent No.: US 7,624,898 B2
(45) Date of Patent: Dec. 1, 2009

(54) DELIVERY SYSTEM

(75) Inventors: James Russell Hornsby, St. Louis, MO (US); Marcellus Rambo Benson, Chesterfield, MO (US); James Augustus Keefe, III, O'Fallon, MO (US); Joseph Lee McGowan, St. Charles, MO (US); Ashley B. Hornsby, Clayton, MO (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 11/505,254

(22) Filed: Aug. 16, 2006

(65) Prior Publication Data

US 2007/0075099 A1 Apr. 5, 2007

Related U.S. Application Data

(63) Continuation-in-part of application No. 11/169,839, filed on Jun. 29, 2005.

(60) Provisional application No. 60/584,290, filed on Jun. 30, 2004.

(51) Int. Cl.
*B67D 5/48* (2006.01)

(52) U.S. Cl. ..... 222/383.2; 222/79; 222/82; 222/83; 222/325; 222/333

(58) Field of Classification Search ..... 222/333, 222/325, 383.2, 547, 564, 82–83, 79, 214; 138/40

See application file for complete search history.

(56) References Cited

U.S. PATENT DOCUMENTS 1,929,564 A * 10/1933 Mair ..... 222/38
2,651,545 A * 9/1953 Shotton ..... 239/333
2,896,977 A 7/1959 Hansen
3,173,584 A * 3/1965 Giavasis ..... 222/263
3,197,070 A * 7/1965 Pearl et. al. ..... 222/79
3,645,298 A * 2/1972 Roberts et al. ..... 138/40
3,709,409 A * 1/1973 Collins ..... 222/402
3,880,329 A * 4/1975 Gardner et al. ..... 222/129.1
3,993,250 A * 11/1976 Shure ..... 222/383.2
4,069,950 A * 1/1978 Archer ..... 222/210
4,095,713 A 6/1978 Norton
4,171,072 A * 10/1979 Davis, Jr. ..... 222/326
4,273,269 A * 6/1981 Davis, Jr. ..... 222/326
4,706,848 A * 11/1987 D'Andrade ..... 222/79
4,767,033 A * 8/1988 Gemperle ..... 222/383.2

(Continued)

FOREIGN PATENT DOCUMENTS

WO 9800214 A1 1/1998

*Primary Examiner*—Frederick C Nicolas
*Assistant Examiner*—Andrew P Bainbridge

(57) ABSTRACT

The present invention relates to an apparatus and method for delivering or dispensing substances. The delivery apparatus comprises a housing, a cartridge for containing the fluid or liquid to be delivered, a conduit system, a nozzle, a pump and an actuating mechanism for actuating a stream of fluid or liquid. The delivery apparatus may include a motor and power source adapted to power the pump. The cartridge containing the fluid or liquid is typically an off-the-shelf container that may be purchased in stores, such as insecticides or household cleaners. The conduit system has an intake opening in fluid communication with the fluid inside the container and another portion in fluid communication with the intake of the nozzle. The conduit system further includes a structure for causing the stream of fluid or liquid to be generally laminar.

8 Claims, 18 Drawing Sheets

U.S. PATENT DOCUMENTS 4,790,454 A * 12/1988 Clark et al. ..... 222/136
4,961,508 A * 10/1990 Weimer et al. ..... 222/214
5,074,437 A * 12/1991 D'Andrade et al. ..... 222/79
5,094,399 A * 3/1992 Zaber ..... 239/135
5,150,819 A * 9/1992 Johnson et al. ..... 222/79
5,238,149 A * 8/1993 Johnson et al. ..... 222/79
5,300,029 A * 4/1994 Denance ..... 604/117
5,305,919 A * 4/1994 Johnson et al. ..... 222/79
5,310,089 A * 5/1994 Hudgins ..... 222/79
5,322,191 A * 6/1994 Johnson et al. ..... 222/79
5,339,987 A * 8/1994 D'Andrade ..... 222/79
5,364,386 A * 11/1994 Fukuoka et al. ..... 604/411
5,429,273 A * 7/1995 King et al. ..... 222/82
5,452,825 A * 9/1995 Comstock et al. ..... 222/135
5,551,605 A * 9/1996 Bethlendy ..... 222/402.25
5,586,688 A * 12/1996 Johnson et al. ..... 222/61
5,758,800 A * 6/1998 D'Andrade ..... 222/79
5,779,099 A * 7/1998 D'Andrade ..... 222/79
5,799,827 A * 9/1998 D'Andrade ..... 222/79
5,850,941 A * 12/1998 Johnson et al. ..... 222/79
5,878,914 A * 3/1999 Johnson ..... 222/79
5,906,295 A * 5/1999 D'Andrade ..... 222/79
6,003,503 A * 12/1999 Johnson et al. ..... 124/69
6,109,480 A * 8/2000 Monsrud et al. ..... 222/83
6,152,333 A * 11/2000 Binder ..... 222/333
6,167,925 B1 * 1/2001 D'Andrade ..... 141/348
6,193,107 B1 * 2/2001 D'Andrade ..... 222/79
6,269,837 B1 * 8/2001 Arent et al. ..... 137/614.04
6,280,277 B1 * 8/2001 Greenberg et al. ..... 446/161
6,321,945 B1 * 11/2001 Girouard et al. ..... 222/113
6,345,732 B1 * 2/2002 Zimmerman et al. ..... 222/79
6,364,162 B1 * 4/2002 Johnson et al. ..... 222/61
6,364,219 B1 * 4/2002 Zimmerman et al. ..... 239/394
6,474,507 B1 * 11/2002 Hornsby et al. ..... 222/79
6,540,108 B1 * 4/2003 Johnson ..... 222/79
6,554,207 B2 * 4/2003 Ebberts ..... 239/146
6,626,380 B1 * 9/2003 Williams et al. ..... 239/375
6,802,436 B2 * 10/2004 Drennow et al. ..... 222/82
6,938,795 B2 * 9/2005 Barton et al. ..... 222/1
7,063,240 B1 * 6/2006 Niswonger ..... 222/391
7,097,073 B2 * 8/2006 Zimmerman ..... 222/79
7,097,119 B2 * 8/2006 Hornsby et al. ..... 239/451
7,328,859 B2 * 2/2008 Hornsby et al. ..... 239/451
7,451,900 B2 * 11/2008 Hornsby et al. ..... 222/325
2002/0020712 A1 * 2/2002 Hornsby et al. ..... 222/79
2002/0127946 A1 * 9/2002 Hornsby et al. ..... 446/176
2003/0089734 A1 5/2003 Eberhardt et al.
2005/0072794 A1 * 4/2005 Zimmerman ..... 222/79

* cited by examiner

DELIVERY SYSTEM

CROSS-REFERENCE TO RELATED APPLICATION(S)

This application is a continuation-in-part of U.S. patent application Ser. No. 11/169,839, filed Jun. 29, 2005, which claims priority to U.S. provisional patent application Ser. No. 60/584,290, filed Jun. 30, 2004, which is incorporated herein by reference in its entirety.

FIELD OF THE INVENTION

The present invention relates to an apparatus and method for delivering or dispensing substances. Delivering or dispensing is intended to mean the applying, delivery, distributing, administering, dispersing, displacing or spraying of a liquid or fluid, including as a stream.

BACKGROUND OF THE INVENTION

Hand operated sprayers are often mounted on containers of household liquids such as window and bathroom cleaners or insecticides and weed killers. A household liquid is dispensed from the hand-operated sprayer by repeatedly squeezing a lever on the sprayer. This can be tiresome. Consequently, powered sprayers have been previously developed to replace the hand-operated sprayers.

These previous powered sprayers suffer from several drawbacks. First, they often cannot be mounted on an off-the-shelf container of household liquid, instead relying on a special reservoir that must be refilled by the user. This can be messy and/or inconvenient for a user. With respect to aerosol can propelled solutions, the negative environmental aspects are well-known. Also, a steel container containing a high pressure is inherently dangerous and expensive. Further, performance is not consistent, i.e., propellant force is stronger initially and weakens as propellant is exhausted.

Second, the previous powered sprayers have spray heads or housings that are substantially larger and heavier than the standard hand operated sprayers. As a result, the previous powered sprayers tend to be top heavy and unwieldy. They tend to be expensive in comparison to non-powered sprayers and, for at least these reasons, are not optimally marketable.

There is a need in the art for a powered sprayer that relieves the need to repeatedly squeeze the lever on the sprayer, can be attached to off-the-shelf containers, is relatively ergonomic and easy to handle and that can deliver the contents of the container from relatively safe distances.

BRIEF SUMMARY OF THE INVENTION

The present invention, in one embodiment, relates to a method and apparatus for application of insecticides or other substances, wherein the application of the insecticide or other substance to a target is accomplished from a distance or range to the target which is relatively equal to or greater than that achieved by aerosol apparatus and methods of dispensing. Therefore, an important feature of this invention is that it can replace or eliminate the need for aerosol dispensers. The invention includes an operating mechanism adapted to provide the user a trigger actuated, automatic power spray for any of a variety of generally liquid or fluid materials. The insecticide or other substance to be delivered is dispensed or ejected from the apparatus in a forceful stream, bursts or series of bursts. In some embodiments, it may be ejected in the form of a rapidly forming cloud or mist. The present invention may be used to dispense virtually any substance which can be dispensed, applied or used in a spray, atomized, vapor, stream, aerosol, or mist form.

An advantage of the present invention is that it enables dispensing or applying of substances, such as insecticides, from a safe distance from the target. For example, the present invention can be used to hit a wasp nest from a relatively greater distance, with a more directed stream, than currently available aerosol dispensers. An effective range for the present invention is from approximately 20 feet up to 35 or more feet although the distance may be varied depending upon the situation of use. For example, the present invention may be used to "shoot" a stream of insecticide at a wasp nest under the roof edge of a garage or house, i.e., at a range of 10-12 feet. As another advantage, the delivery system of the present invention will deliver the fluid 20 or more feet whether the cartridge is full, half full or nearly empty.

In one embodiment, the present invention comprises a gun-like applicator or dispenser comprising a body and a cartridge, wherein the body and cartridge are adapted to be connected so the contents of the cartridge can be ejected therefrom. In some embodiments, the cartridge is disposable, and can be removed from the body after being exhausted so that a new cartridge can be connected. The user does not come in contact with the fluid at any time.

In one embodiment, the present invention comprises a method and apparatus for applying an insecticide to a target insect or nest of insects from far away. The apparatus comprises a sprayer adapted to receive a replaceable cartridge of insecticide, including a conduit system and a nozzle wherein the conduit system includes a structure for creating a coherent or laminar flow of the insecticide from the nozzle. In one embodiment, the structure for creating the coherent or laminar flow is a PVC baffle structure. Other suitable structures or features for creating a coherent or laminar flow of insecticide may be used as well.

In one embodiment, the present invention comprises a dispenser adapted to be coupled to a fluid container. The dispenser comprises a dispensing head, an energy source, and a fluid pathway. The dispensing head includes a fluid pump, a motor adapted to power the pump, a trigger adapted to control the motor, and a nozzle orifice in fluid communication with a discharge end of the pump. The fluid pathway has one portion in fluid communication with an intake end of the pump and another portion inside the container.

In one embodiment, the invention includes a pick up tube, disposed inside the container or bottle to which the sprayer is attached, that is weighted and sufficiently flexible to allow the power sprayer to work at any angle including upside down.

In one embodiment, the weight at the end of the pick-up tube may be a die cast or brass weight with a slot in the end. The slot keeps the intake associated with the weight from being blocked or shut off against the side of the bottle. In one embodiment, the pick up tube to which the weight is attached is a very flexible silicon or like material, although any material may be selected as long as it is sufficiently flexible. The length of the pick up tube should be selected so that it does not get caught or tangled.

In one embodiment, the present invention comprises a dispensing attachment for mounting on or to a cartridge containing a substance to be dispensed, wherein the dispenser comprises a power source, e.g., batteries, a motor, an operating mechanism, a pump, a nozzle, and a pick up tube.

In one embodiment, the sprayer unit of the present invention is designed to fit an off-the-shelf fluid container. Alternatively, in another embodiment, the sprayer unit may be designed to fit any standard cleaner bottle or may comprise an empty bottle that the user can fill and use to dispense substances.

In one embodiment, the present invention comprises a battery operated liquid spray pump which may be used interchangeably on typical containers or bottles for a variety of substances. Thus, the spray pump of the present invention may be used for a variety of purposes. For example, in the home, cleaning solutions such as window cleaners may be sprayed or dispensed with it. In the garage, for automotive uses, various cleaning materials may be dispensed or applied using the sprayer of the present invention. In the garden, the present invention may be used for spraying or dispensing insecticides, herbicides or for misting plants. It may be used in a wide variety of applications or uses at home or on the job, anywhere sprayers are currently in use.

In one embodiment, the pump unit or sprayer of the present invention has six batteries (or as many batteries as suitably required) that are housed inside the sprayer. In other embodiments, other suitable power sources (e.g., a capacitor, capacitors, etc.) may be used.

In one embodiment, the sprayer of the present invention comprises a trigger, for example, a push button type trigger, that switches on a motorized pumping system, bringing the liquid to the sprayer nozzle under pressure and producing an adjustable spray mist. The trigger permits on/off fingertip control. The user simply touches or depresses the button when the spray is desired; on the other hand, the user simply releases the button to stop the spray.

Other features of the present invention may include a nozzle which is adjustable from a fine mist to a strong, substantially coherent stream. The attachment feature of the spray head unit of the present invention may be adapted to fit a typical standard size bottle or container, and in some embodiments, it may be adapted to be adjusted to containers with openings of various sizes. In one embodiment, the attachment feature or connector is a threaded adapter piece. The electrical system associated with the present invention should be water resistant whereby components should not rust or corrode due to contact with water or chemicals, including insecticides, cleaning agents or soap. In one embodiment, the present invention comprises a motorized gear pump and nozzle for attaching to a container whereby the contents of the container may be dispensed. In other embodiments, the present invention may comprise a piston pump or other suitable pumping mechanism.

In some embodiments, the present invention includes a safety lock, which can comprise any suitable method for an operator to conveniently and easily lock and unlock the trigger or operating button of the invention. In one embodiment, this may comprise a safety lockout lever or slide type button. In some embodiments, the invention may be made available with a child safety cap.

In one embodiment, the present invention comprises a motorized spray unit comprising a motor, a gear pump, a flex weighted liquid draw or pick up tube, a battery housing and an adjustable nozzle. Suitable liquid conduits may be used to connect the liquid conducting portions of the invention and to provide a flow path. In one embodiment, the present invention uses a simple trigger or push button actuation switch to replace the manual pump and pump trigger or operating mechanisms typically found on such sprayers, and allows the user to spray without excessive finger or hand pumping or flexion. In some embodiments, the switch may be an "on/off" switch having two states. In other embodiments, a variable speed switch arrangement may be used. Such an arrangement may incorporate microprocessor, rheostatic or other suitable control components.

In one embodiment, the nozzle is rotatable between selected dispensing configurations including spray and stream. The nozzle, and/or the sprayer, may be adapted to provide indications, graphically or otherwise, of these and/or other operable conditions. In some embodiments, the sprayer may be adapted, by incorporating suitable electronic components, to provide sensing and indicating features and/or electronic control features, e.g., adjustable, rheostatic output pressure control. For example, the sprayer could sense and display dispensing pressure, contents remaining, etc. It could also be adapted to provide a visual signal of operating states, e.g., battery capacity remaining, by providing a suitable light source, e.g., a bulb, LED, etc. It could also be adapted to provide other types of signals, e.g., visual, tactile, audible, etc. to users or potential purchasers.

In one embodiment, the present invention comprises a powered, motorized spray pump head including a battery housing, batteries, a weighted straw-like liquid draw or pick-up tube, a soft flexible tube, a pump, a motor and gear assembly, safety lockout tab, a primer chamber, a multiple position nozzle, a trigger contact switch and a trigger. Note that the safety lock tab may be adapted to interrupt the power supply and/or physically permit or not permit positioning or depression of the trigger.

The components of the present invention are appropriately housed in or extend from a housing which may be formed of a number of connected pieces, or which may be formed as a single piece.

In one embodiment, the present invention comprises a housing for containing or mounting the operable components and features of the present invention. At the outlet end of the housing, the invention includes a cap of a nozzle which provides for adjustment of the spray. The housing is adapted to carry a threaded, cap-like structure for connection to the neck of a bottle or other container.

In one embodiment, the present invention comprises a handheld spray gun and supply unit comprising a housing with a hand grip portion, a pump assembly mounted in the housing including a pump and a nozzle. An electric motor is mounted in the housing, and batteries are within a special container associated with the housing. The batteries are electrically connected to the motor. A switch on a face of the housing adjacent to the hand grip is provided for actuating or operating the motor and, therefore, the pump, and a tube depends from the housing into the container for supplying liquid from the container to the intake for discharge through the nozzle.

The present invention, in another embodiment, is a dispensing attachment for coupling to a container containing a substance to be dispensed. The dispensing attachment comprises a motor, an actuating mechanism adapted to actuate the motor, a pump driven by the motor and including an intake end and a discharge end, a housing enclosing the motor and pump, a nozzle in fluid communication with the discharge end of the pump, and a generally flexible pick-up tube. The generally flexible pick-up tube has a first end and a second end. The first end is in fluid is in fluid communication with the intake end of the pump. The second end is free and carrying a weight formed of a corrosion and rust resistant material.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

Figure 1:
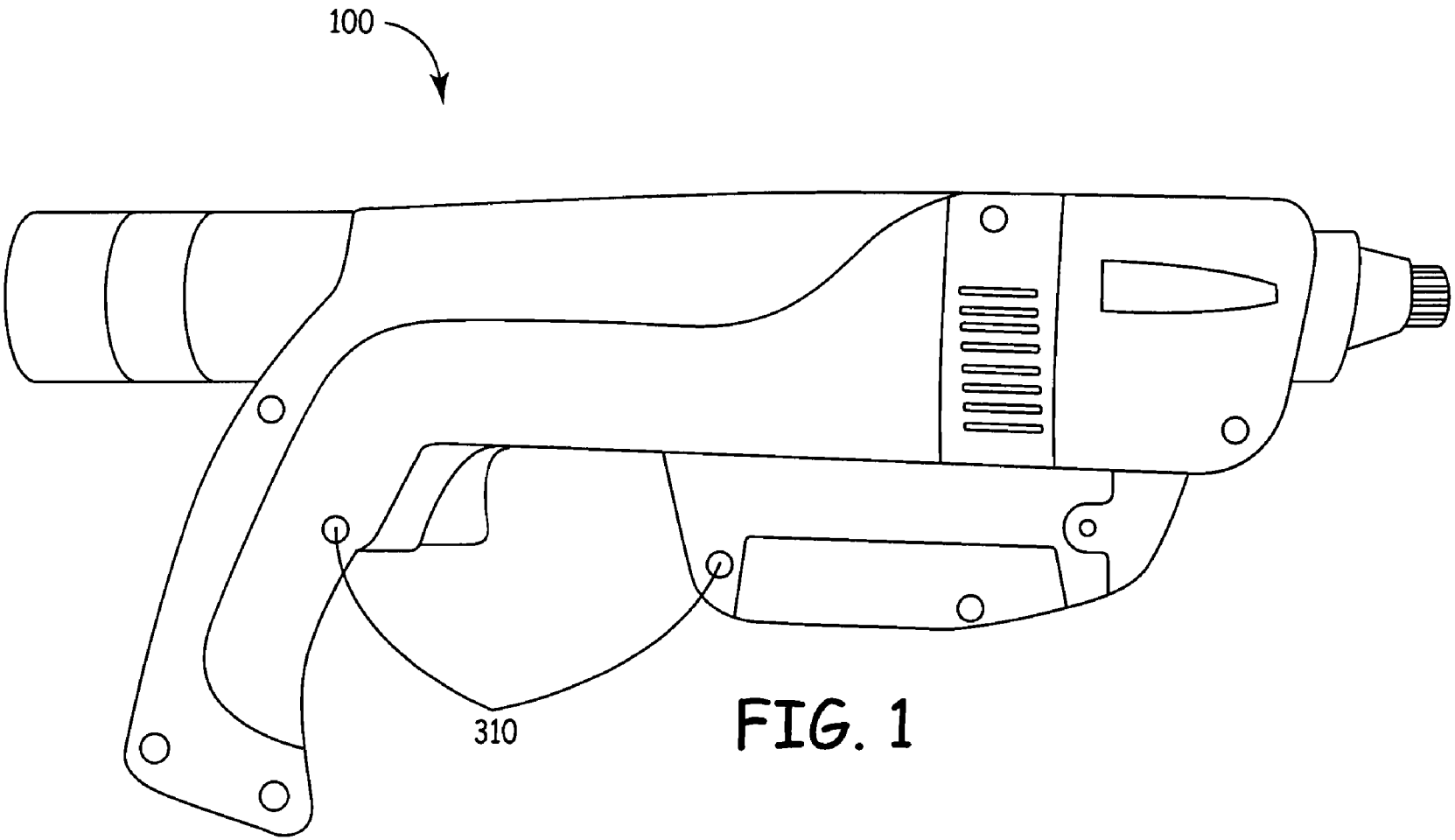
FIG. 1 is a side view of one embodiment of the handheld power sprayer of the present invention.

The present invention is a novel and advantageous handheld power sprayer that has a motorized means for pumping a fluid from a reservoir containing the fluid. Referring to FIG. 1, the present invention provides, in one embodiment, an insecticide delivery system in the form of a handheld power sprayer 100. Although a pistol or gun-like shape is depicted, any suitable exterior configuration may be used as long as it facilitates the delivery or application of an insecticide, and the handling, use and storage of the apparatus.

Figure 2:
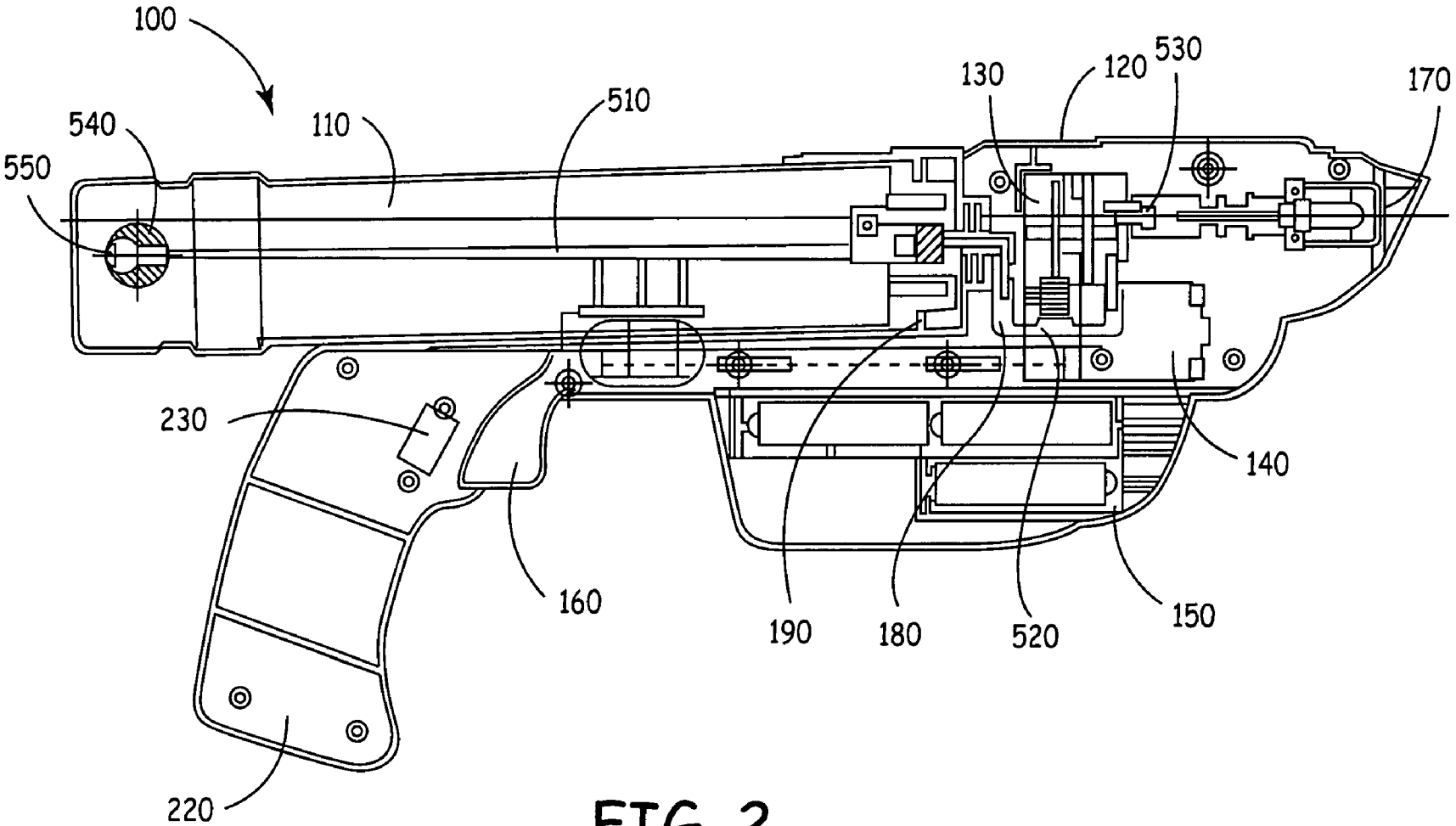
FIG. 2 is a cross section view of one embodiment of the handheld power sprayer of the present invention coupled to a cartridge.

FIG. 2 is a cross sectional view of the handheld power sprayer 100 of the subject invention mounted on a fluid cartridge 110 (i.e., a container of common household, garage or gardening liquid such as bathroom cleaner, window cleaner, insecticides, fungicides, herbicides, pesticides, water, etc.). As shown in FIG. 2, the power sprayer 100 comprises a housing 120 which contains or mounts a pumping mechanism 130, a motor adapted to power the pump 140, a power source 150, an actuating mechanism in the form of a trigger 160, a nozzle 170, a conduit system 180, a coupling 190 and a disposable cartridge 110.

Figure 3:
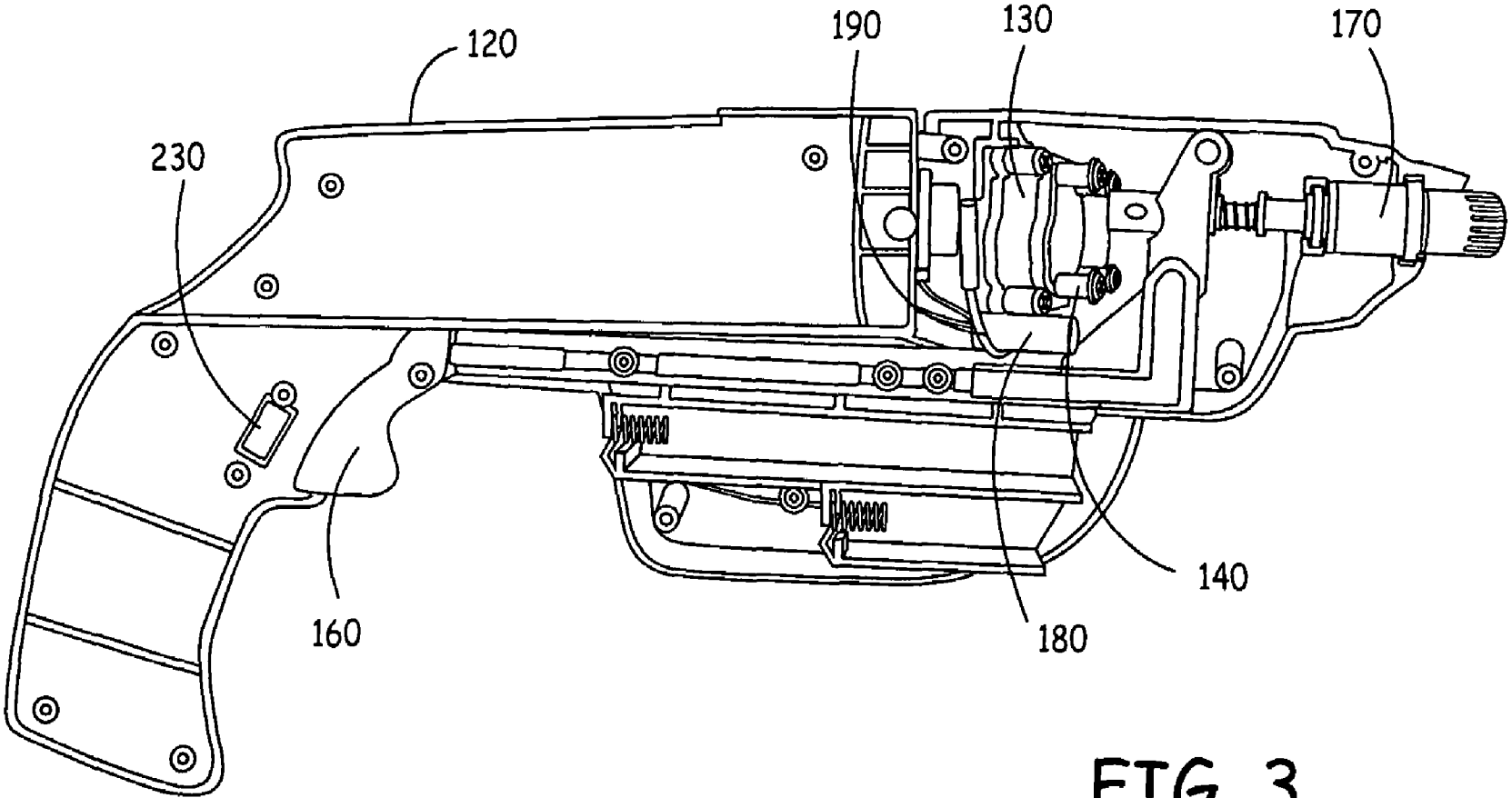
FIG. 3 is a cross section view of one embodiment of the handheld power sprayer of the present invention with the cartridge removed.
Figure 4:
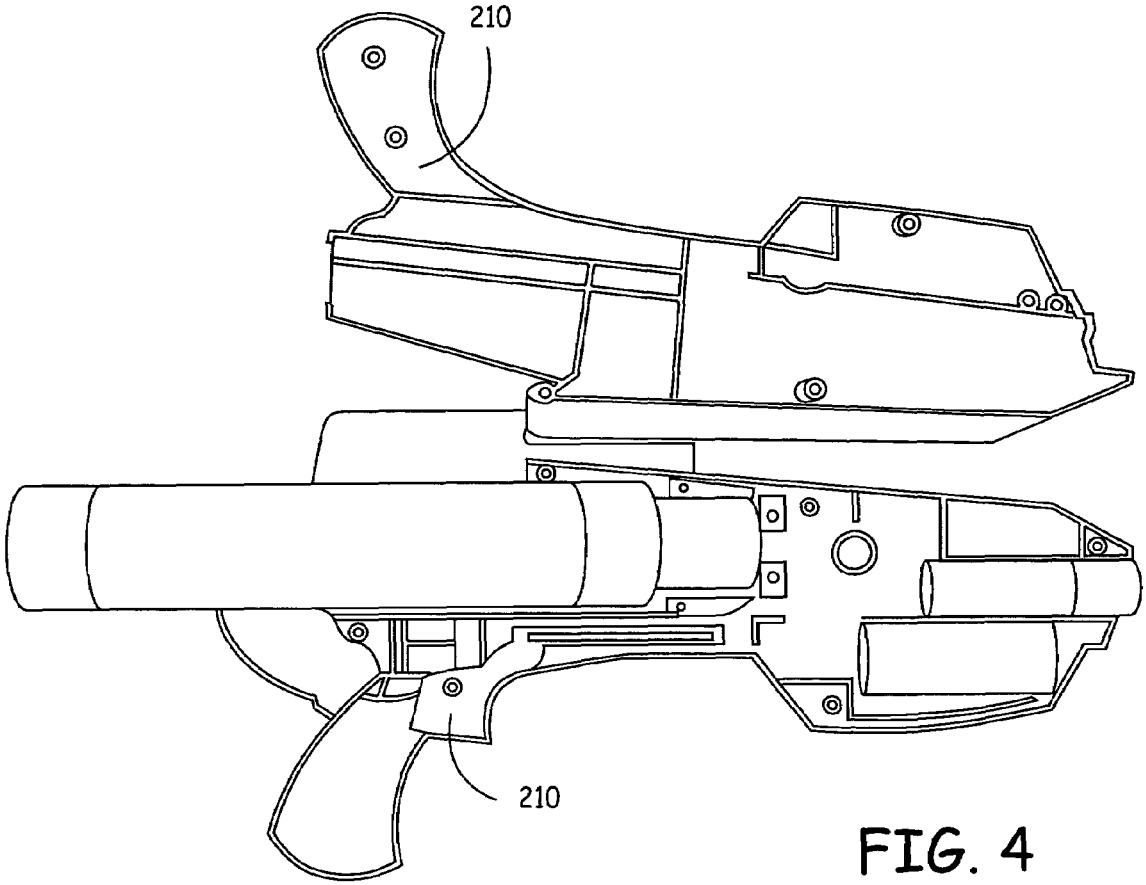
FIG. 4 is an elevation view of one embodiment of the outer shells of the housing employing a clam shell design.

FIG. 3 is a cross-sectional view of the handheld power sprayer 100 wherein one half of the housing 120 is removed and the housing 120 is not mounted on the cartridge 110. The housing 120 is typically manufactured from a plastic or metal. Alternatively, those skilled in the art will recognize that any suitable material may be used. The housing 120 generally consists of two outer shells 210 that are adapted to be securely attached to one another. The outer shells 210 are securely attached by using screws 310, as illustrated in FIG. 1. Alternatively, the outer shells 210 may be adapted to snap-fit with one another or be attached using any other known means of attachment. In one embodiment, the outer shells 210 may comprise a clam shell structure or design as depicted in FIG. 4.

Figure 5:
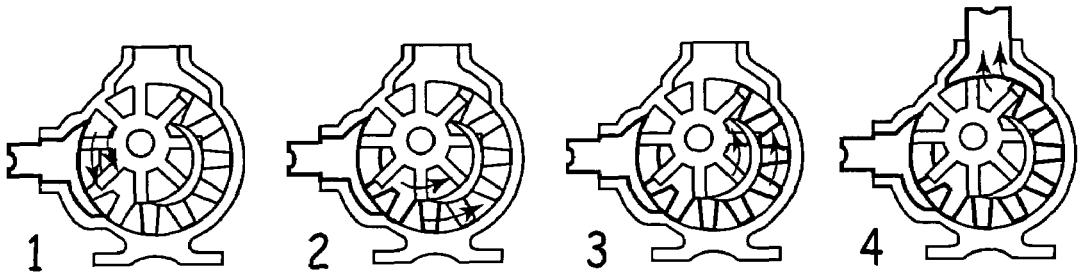
FIG. 5 is a flow diagram of an internal gear pump that may be used in the present invention.
Figure 6:
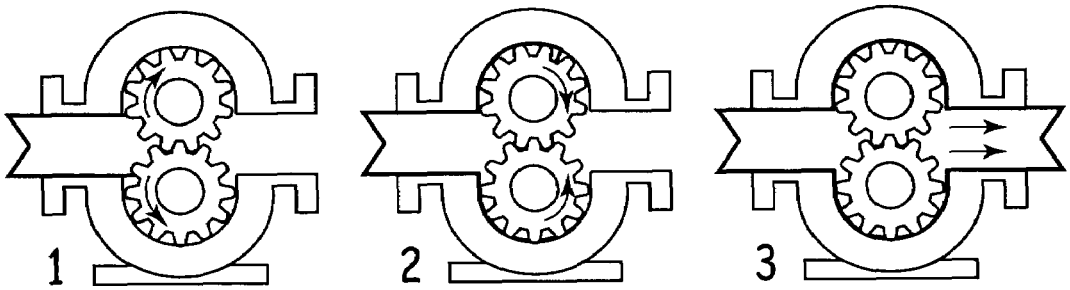
FIG. 6 is a flow diagram of an external gear pump that may be used in the present invention.
Figure 7:
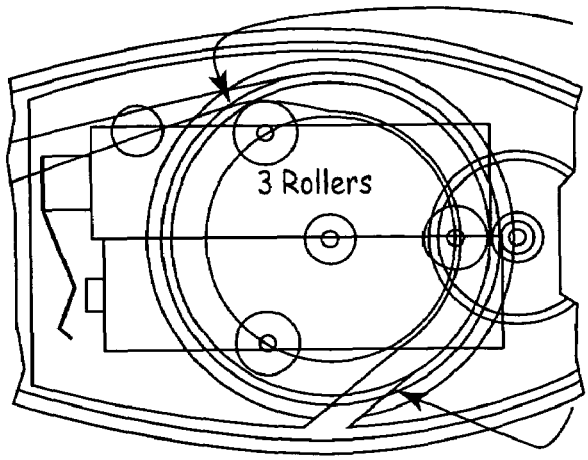
FIG. 7 is a elevation view of a peristaltic pump that may be used in the present invention.

The pumping mechanism 130, in one embodiment of the present invention, is a gear pump. With a motor powered, gear pump 130, the cartridge 110 of the present invention does not need to be pressurized. Similarly, there is no need for high pressure fittings or a pressure release valve. While FIG. 2 illustrates the employment of a gear pump 130, those skilled in the art will readily understand that a piston pump, peristaltic pump, dual reciprocating pump, progressive cavity pump or other suitable pumping mechanism may be substituted for the gear pump 130 without departing from the spirit of the invention. FIGS. 5 and 6 illustrate some embodiments of a gear pump that may be used in conjunction with the power sprayer 100 of the present invention. FIG. 7 illustrates one embodiment of an alternative pump, in the form of a peristaltic pump, that may be substituted for the gear pump 130.

The motor 140 will typically be a small, electric DC RPM motor, which is adapted to power the pumping mechanism 130. Alternatively, any other known means in the art for powering the pump 130 may be used. The motor 140 is powered by the power source 150.

Figure 8:
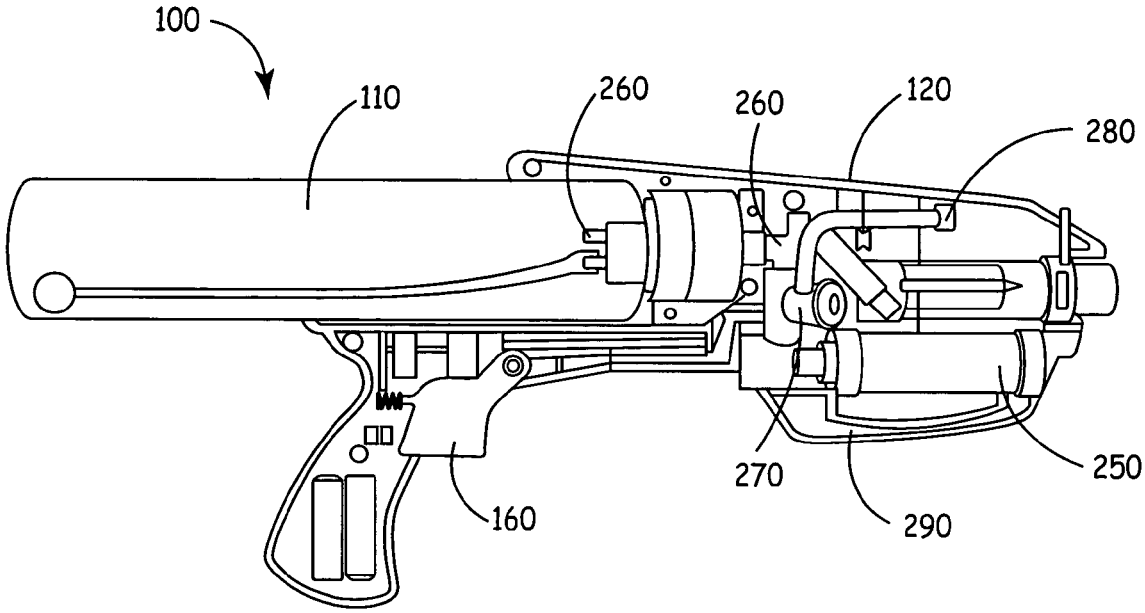
FIG. 8 is a cross section view of one embodiment of the handheld power sprayer of the present invention employing a reciprocating, hand pump.

In an alternate embodiment, the pumping mechanism 130 may be an air pump 250, as shown in FIG. 8. In such an embodiment, a motor 140 is not necessary. The sprayer 100, particularly the cartridge 110, is charged or pressurized by using an air pump 250 to drive air through an airflow pathway 260, past a one-way valve 270 and into the cartridge 110. The one-way valve 270 may be a purge valve, or a separate purge valve may be provided. The purge valve 270 provides that when the operating pressure in the cartridge 110 is reached, air moved by further pumping is released through the purge valve 270. The purge valve 270, another valve and/or the airflow pathway 260 may be adapted to provide an audible indication that the cartridge 110 is pressurized. For example, a whistle 280 may be coupled to the purge valve 270 such that when air begins to flow through the purge valve 270, the whistle 280 sounds.

In use, a user would pump the air pump 250 using a reciprocating handle 290 to pressurize the cartridge 110, pumping until a "cartridge pressurized" signal is heard. In some embodiments, a single stroke, pressurization pump, i.e., a pump that moves air into the cartridge 110 as it is moved in one direction, but not in the other, is used. In some embodiments, a dual action pump, which moves air into the cartridge 110 in both directions of pumping, may be used.

In some embodiments, the power source 150 can comprise a battery or batteries, which, in some embodiments, can be rechargeable. In one embodiment, as indicated in FIG. 2, the housing 120 contains six AA batteries that may be replaced when depleted. In other embodiments, the housing 120 may include a greater or lesser number of batteries. Also, the batteries may be other sizes, such as AAA.

In one embodiment, the disposable batteries are replaced with a rechargeable battery. Once the energy is depleted from the rechargeable battery, it is removed from the housing 120 and inserted into a charger for recharging. In some embodiments, recharging may be accomplished inductively. In other embodiments, the rechargeable battery may be permanently installed in the housing 120 and recharged by connecting the power sprayer 100 to a wall socket, generator, etc. using appropriate connecting means.

Similarly, in circumstances where using batteries is undesirable, the power sprayer 100 of the present invention may be powered directly by an alternate power supply, such as a wall socket or generator, using appropriate connecting means. For example, the power sprayer 100 may be powered by connecting a power cord to the power sprayer 100 and then plugging the power cord into a wall socket.

In one embodiment, where the sprayer 100 itself is meant to be disposable, the disposable batteries are replaced with a capacitor and coil system or a set of permanently installed non-rechargeable batteries. Thus, once the energy in the capacitor or non-rechargeable batteries is depleted, the entire sprayer 100 is thrown away. In some embodiments, the power source 150 may be located adjacent to the motor 140, as shown in FIG. 2. Alternatively, the power source 150 may be located in any other suitable location, such as in the handle 220 of the power sprayer 100.

The trigger 160 is used to actuate the sprayer 100. As indicated in FIG. 2, in one embodiment, the power sprayer 100 is actuated by partially displacing the trigger 160 into the housing 120. Generally, in operation, the trigger 160 is pressed into the housing 120 and in contact with contact pad 230, thereby completing/closing the electrical circuit running from the power source 150 to the motor 140. Other actuating mechanisms may be used in place of a trigger 160, such as a push button or switch.

Rheostatic arrangements, switches or circuits are well-known, and any suitable rheostatic arrangement, switch or circuit can be used in a sprayer 100 in accordance with the present invention to, for example, control or regulate the speed of the motor 140 at the actuating mechanism or trigger 160, thereby controlling the speed that the pump 130 cycles and the amount of fluid discharged. Note that, in a sprayer 100 in accordance with the present invention, the trigger 160 may be urged to its off position by a suitable spring or other biasing or tensioning device.

In some embodiments, the actuator or trigger 160 is lockable to prevent accidental discharge and/or use by children. In one embodiment, the locking mechanism comprises tumblers which must be positioned in an unlocked position to depress the trigger 160. Other locking mechanisms may be used and/or provided as well, including, for example, a detent type lock for locking the cartridge in place, a slide lock for locking the trigger, etc.

Figure 9:
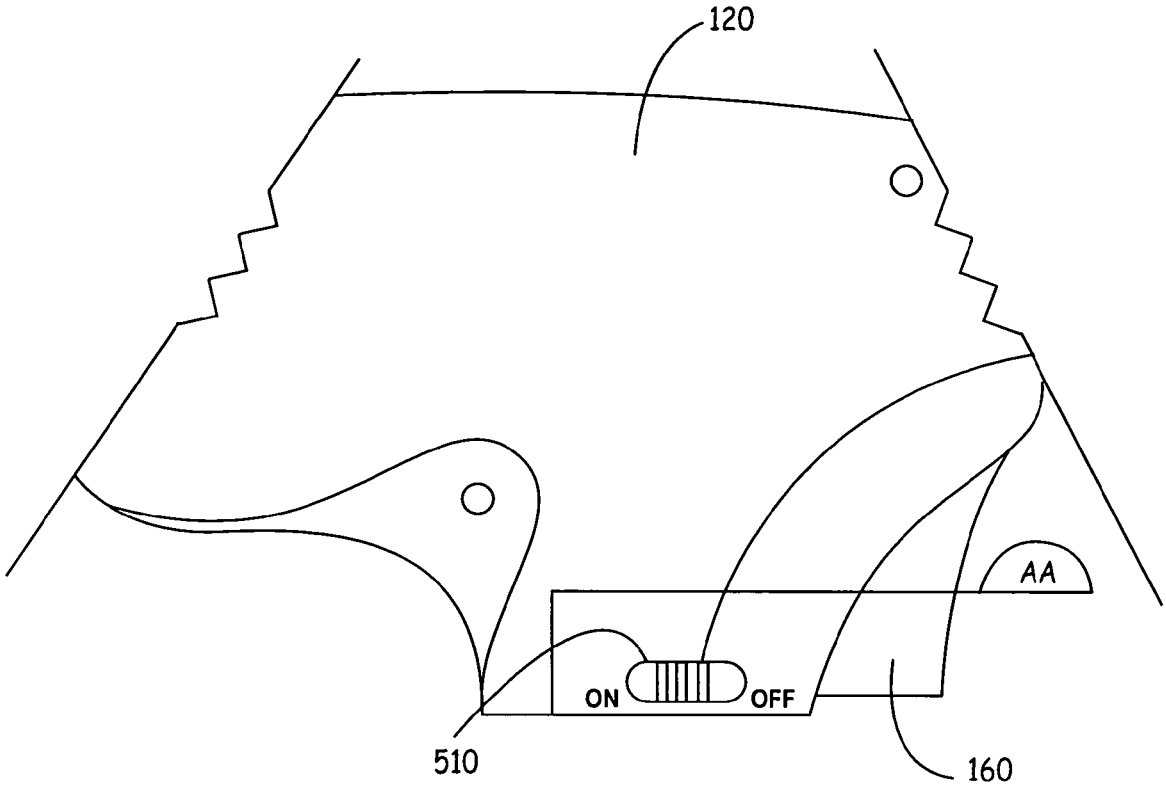
FIG. 9 is a side view of a portion of one embodiment of the handheld sprayer of the present invention illustrating a safety lock.
Figure 10:
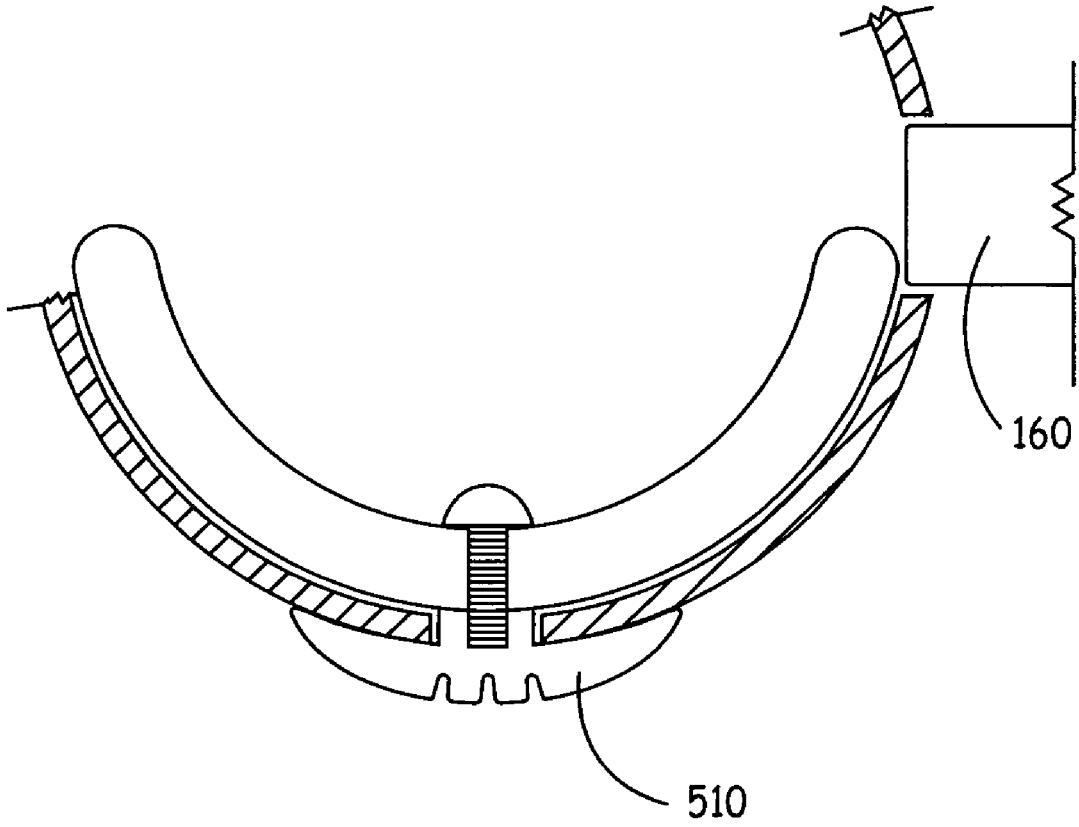
FIG. 10 is a cross section view of one embodiment of the safety lock that may be included in the present invention.

As illustrated in FIGS. 9 and 10, in one embodiment, the safety lock 510 is horizontally displaceable along the housing 120 between a position marked "OFF" and a position marked "ON." As shown in FIG. 10, which is a plan view of the safety lock 510 in the off position as taken along section line AA in FIG. 9, when the safety lock 510 is slid into the off position, which is closer to the trigger 160 than the on position, the safety lock 510 prevents the trigger 160 from displacing into the housing 120. Thus, when the safety lock 510 is in the off position, the power sprayer 100 cannot be actuated via the trigger 160. Conversely, when the safety lock 510 is in the on position, the trigger 160 may be displaced into the housing 120 to actuate the power sprayer 120.

In other embodiments, the sprayer 100 may employ other safety measures for preventing unintentional discharge from the sprayer 100. These safety measures may include other mechanical means for locking and unlocking the trigger 160, means for preventing the completion of the electrical circuit powering the sprayer 100, and/or a child-proof safety cap for placement on the nozzle 170.

Any of the embodiments of the powered sprayer 100 of the present invention may be provided with a suitable dispense characteristic adjustment nozzle 170. Such nozzles include standard-type spray, stream, adjustable nozzles which provide for a stream of the substance to be dispensed, e.g., a nozzle with straight channels inside the nozzle cap to produce a high velocity narrow stream. For spray or mist characteristics, the nozzle 170 may be adapted by having, for example, suitable grooves in a spiral to impart spin and turbulence. Such a nozzle can produce a plume or cloud of the product to be dispensed in fine, medium and coarse characteristics.

In another embodiment, the nozzle 170 may comprise an "infinity" spray-to-stream adjustable nozzle. This type of adjustable nozzle is well known to those skilled in the art and includes, or is exemplified by, screw-type nozzles with a full range of stream and spray patterns. Any of the nozzle 170 embodiments may include a snap fit, removable cap to allow rinsing or cleaning of the cap and/or the nozzle 170.

Figure 11:
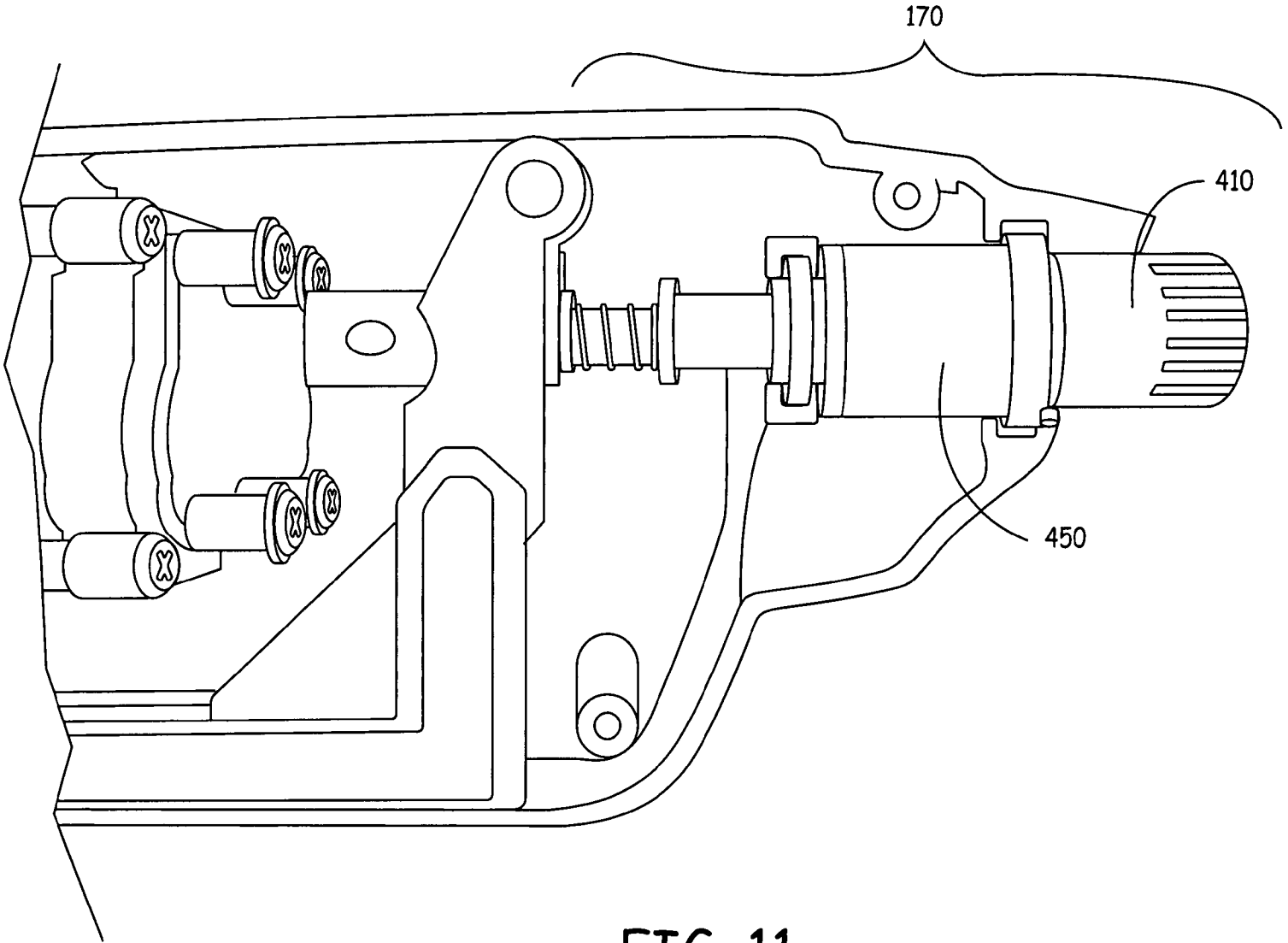
FIG. 11 is a cross section view of one embodiment of the nozzle of the present invention.
Figure 12A:
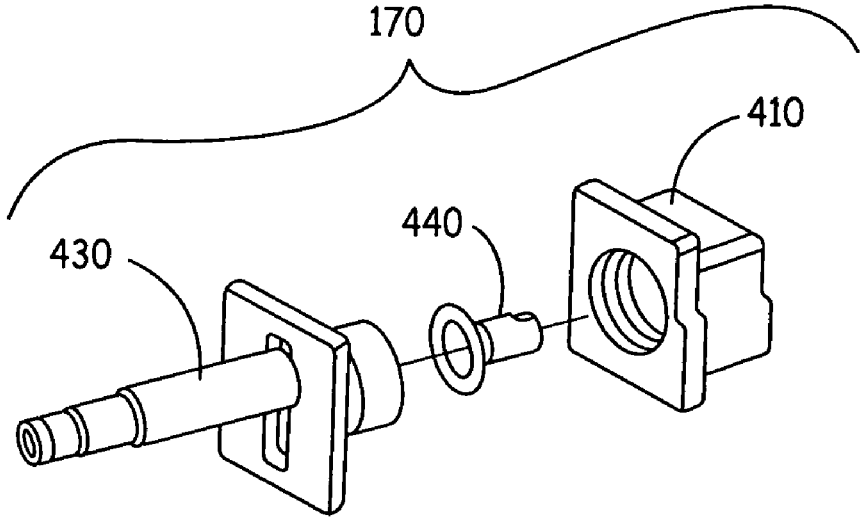
FIG. 12A is a broken apart, perspective view of one embodiment of the nozzle of the present invention.

As indicated in FIGS. 11 and 12A, the nozzle cap 410 is pivotally attached to the housing 120 and allows a user to select between a spray or stream-type application of the fluid. According to one embodiment as shown in FIG. 12, the nozzle 170 includes a nozzle tube 430, a nozzle valve 440 and a nozzle cap 410. In one embodiment, the nozzle cap 410 has four sides and each side could have a word or other indicia on it, such as "SPRAY" or "STREAM." In some embodiments, other indicators, words or indicia, e.g., the word "OFF," could be used on one of the sides. To select a stream-type application (i.e., the liquid flow from the nozzle cap 410 is a strong, generally coherent stream), the nozzle cap 410 is pivoted until a side of the nozzle cap 410 with the word "STREAM" is facing upwards. Similarly, to select a spray-type application (i.e., the liquid flow from the nozzle cap 410 is a generally fine mist), the nozzle cap 410 is pivoted until a side of the nozzle cap 410 with the word "SPRAY" is facing upwards. In embodiments including an off setting, when the nozzle cap 410 is pivoted until a side of the nozzle cap 410 with the word "OFF" is facing upwards, the nozzle cap 410 will be shut off and no flow will be able to emit from the nozzle 170.

The nozzle 170 of the present invention may be available in a spray only configuration, or it could be available in a foaming nozzle arrangement, wherein air intakes allow air to be introduced into the stream of material passing through the nozzle 170 either in a stream or spray pattern. This air introduction creates turbulence to mix air and the fluid to be dispensed for foaming action. Additionally, any of the nozzle 170 embodiments could be adapted to accommodate attachments, working ends or tools for specific purposes, e.g., scrubbing, polishing, disinfecting, etc.

Figure 12B:
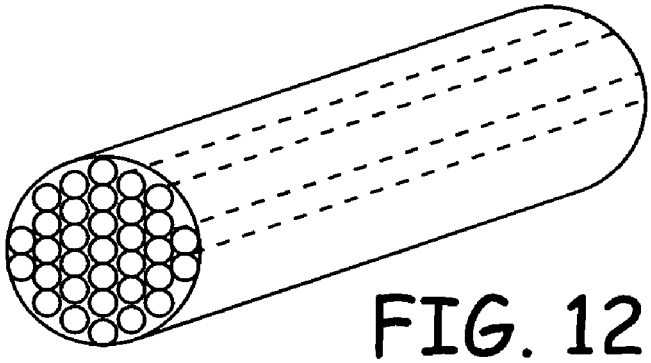
FIG. 12B is a perspective view of one embodiment of the structure for creating a coherent or laminar flow of the present invention.
Figure 12C:
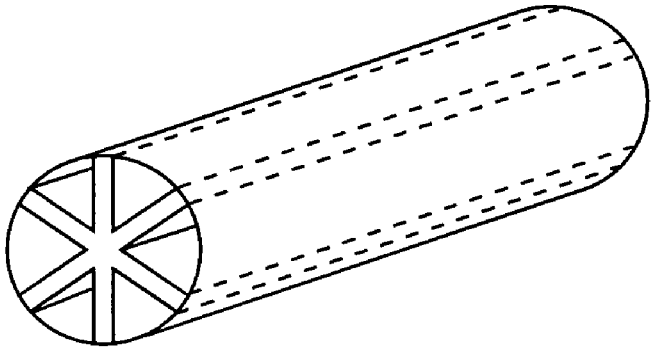
FIG. 12C is a perspective view of an alternate embodiment of the structure for creating a coherent or laminar flow of the present invention.

In one embodiment, the conduit system 180 includes a structure for creating a coherent or laminar flow of material issuing from the nozzle 170. The nozzle 170 is divided by a reticulated foam plug, suitable baffle, straw stack (e.g., a plurality of parallel tubular bodies bundled or arranged with their axis parallel to the central longitudinal axis of the nozzle as illustrated in FIG. 12B) or the like into a rear swirl, or turbulence, chamber into which the water from the pump enters and a forward linear flow, or coherent flow, chamber from which the substance is emitted through a sharply beveled orifice. Basically, the arrangement or structure for providing for a coherent or laminar flow provides for the reduction of turbulence, and any turbulence reducing structure or method may be adapted to provide for a coherent or laminar flow or stream from the deliver apparatus, including, for example, star-shaped chambers, stacks or bundles of materials, foam plugs, shaped chambers or chamber walls as illustrated in FIG. 12C, etc. Creating a coherent or laminar stream makes it possible to extend the distance through which the fluid or liquid can effectively and efficiently be delivered. Typically, the structure for creating a laminar flow is located in a center chamber 450 of the nozzle 170, depicted in FIG. 11.

As shown in FIG. 2, the conduit system 180 has an intake end that terminates within the cartridge 110 and a discharge end that is in fluid communication with the nozzle 170 contained in the housing 120. Typically, the conduit system 180 includes an intake tube 510, a first fluid pathway 520 in fluid communication with the discharge of the intake tube 510 and the intake of the pump 130 and a second fluid pathway 530 in fluid communication with the discharge of the pump 130 and the intake of the nozzle 170.

In one embodiment, the intake tube 510 is permanently carried inside the cartridge 110. The intake tube 510 is a very flexible silicone rubber. In other embodiments, the intake tube 510 may be some other very flexible polymer. The length of the intake tube 510 is sufficient to reach the bottom of the container, but not so excessive that it tangles with itself.

In a further embodiment, the intake tube 510 carries a weight or clunk 540 near, or at, the intake opening 550 of the intake tube 510. In one embodiment, the weight 540 is a very dense polymer sphere. In other embodiments, the weight 540 may be ceramic, glass, rubber, die cast metal, brass, etc. Regardless of the material selected, the material should be resistant to the corrosive effects of the liquid contained in the cartridge 110 and dense enough to sink in the liquid. The weight 540 is sized to be sufficiently heavy to draw the intake opening 550 of the intake tube 510 to the bottom most portion of the fluid contained in the cartridge 110, regardless of whether the cartridge 110 is oriented upright, sideways, upside down, etc.

Figure 13:
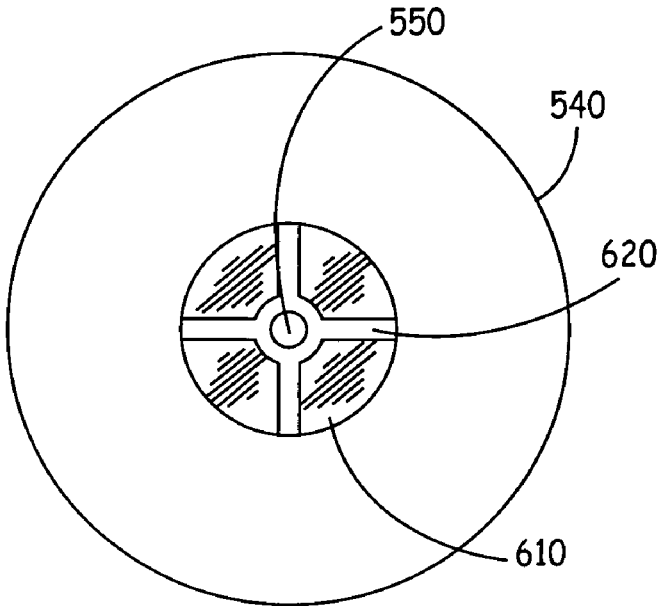
FIG. 13 is a front elevation view of one embodiment of the weight or clunk of the present invention.
Figure 14:
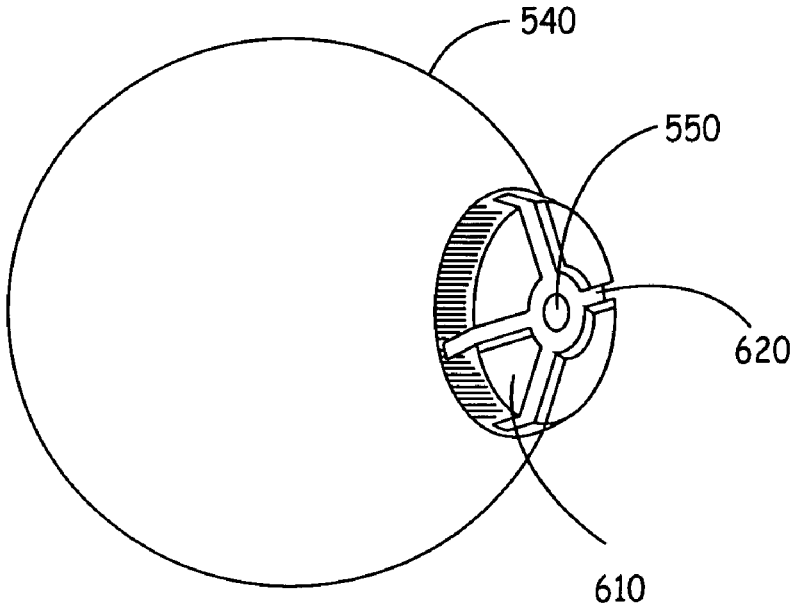
FIG. 14 is a perspective view of one embodiment of the weight or clunk of the present invention.

As indicated in FIGS. 13 and 14, which are front elevation and isometric views, respectively, of the weight 540 that is mounted on the end of the intake tube 510, the intake opening 550 is recessed in the center of a disc 610 mounted on the weight 540. The disc 610 has channels 620 that run from the outer circumference of the disc 610 to the intake opening 550, thereby forming protrusions that extend beyond the intake opening 550. The channels 620 prevent the intake opening 550 from being blocked by a surface of the cartridge 110.

The weight 540 equipped intake tube 510 is advantageous because it allows the sprayer 100 to operate regardless of the orientation of the sprayer 100 and its attached cartridge 110. For example, when the sprayer 100 is operated in an upright position, the weight 540 causes the intake opening 550 of the intake tube 510 to sink to the bottom of the fluid. Likewise, when the sprayer 100 is operated in an upside down position and the fluid has accumulated near the neck 710 of the cartridge 110, the weight 540 causes the intake opening 550 of the intake tube 510 to sink to the bottom of the fluid (i.e., near the neck 710 of the cartridge 110). Thus, regardless of the orientation of the cartridge 110, the weight 540 causes the intake opening 550 of the intake tube 510 to be kept in fluid communication with the fluid in the cartridge 110.

In one embodiment, the cartridge 110 is operably coupled to the first fluid pathway 520 by a coupling 190, whereby the substance in the cartridge 110 is conveyed to or flows to the pump 130.

Figure 15:
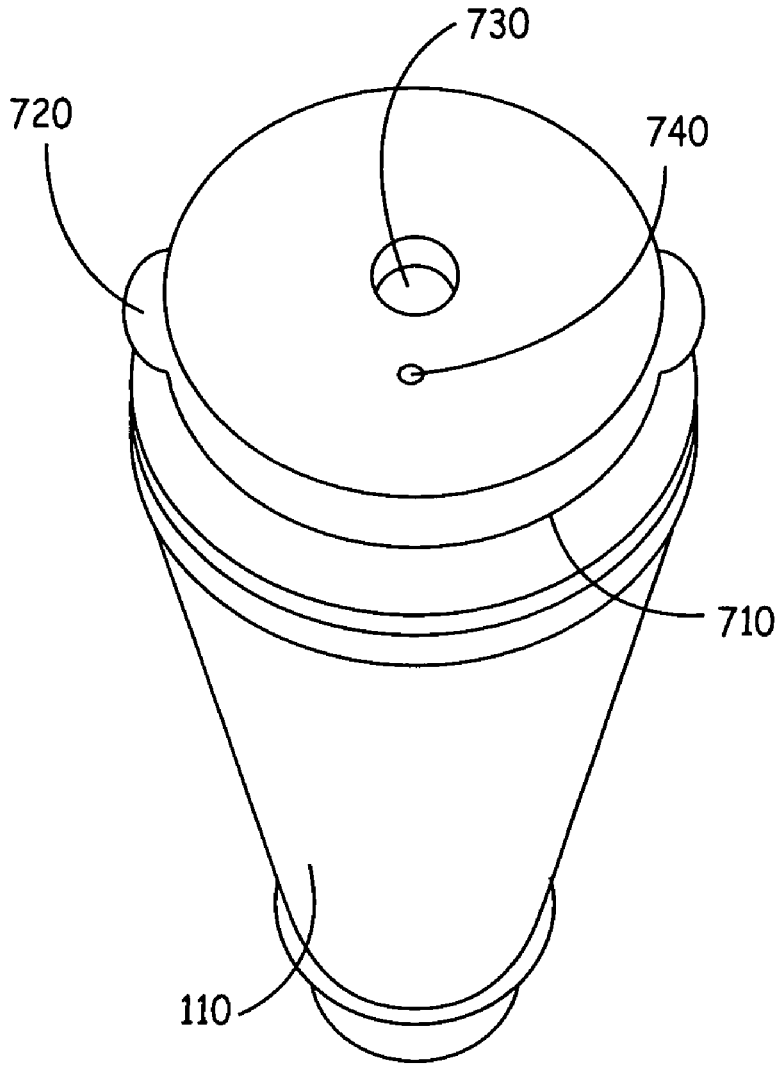
FIG. 15 is a top perspective view of one embodiment of the cartridge of the present invention.
Figure 16:
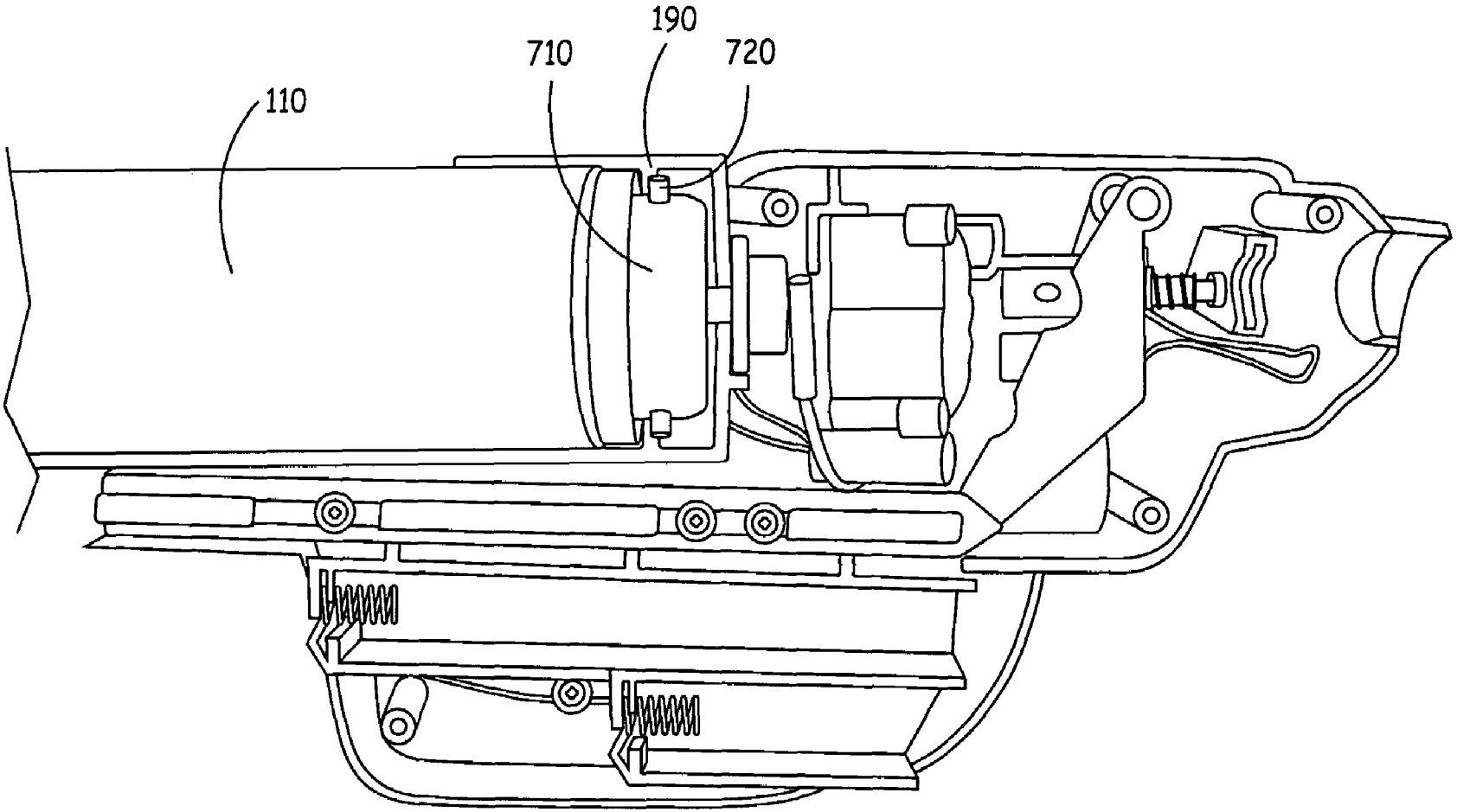
FIG. 16 is a cross section view illustrating the cartridge attached to the housing in one embodiment of the present invention.

FIGS. 15 and 16 depict details of one embodiment of the cartridge 110 suitable for use in the power sprayer 100 of the present invention. In such an embodiment, the cartridge 110 employs bayonet-type attachment means for attaching the cartridge 110 into the operational structures of the housing 120. The cartridge 110 has a neck 710 having at least one (two are shown) axial extension 720. The housing 120 couples to the cartridge 110 via coupling 190 adapted to receive the axial extensions 720 of the neck 710. Typically, a user inserts the cartridge 110 by aligning the axial extensions 720 with corresponding axial recesses in the coupling 190; the user then rotates the cartridge 110 such that the axial extensions 720 are no longer in alignment with the axial recesses of the coupling 190.

Figure 17:
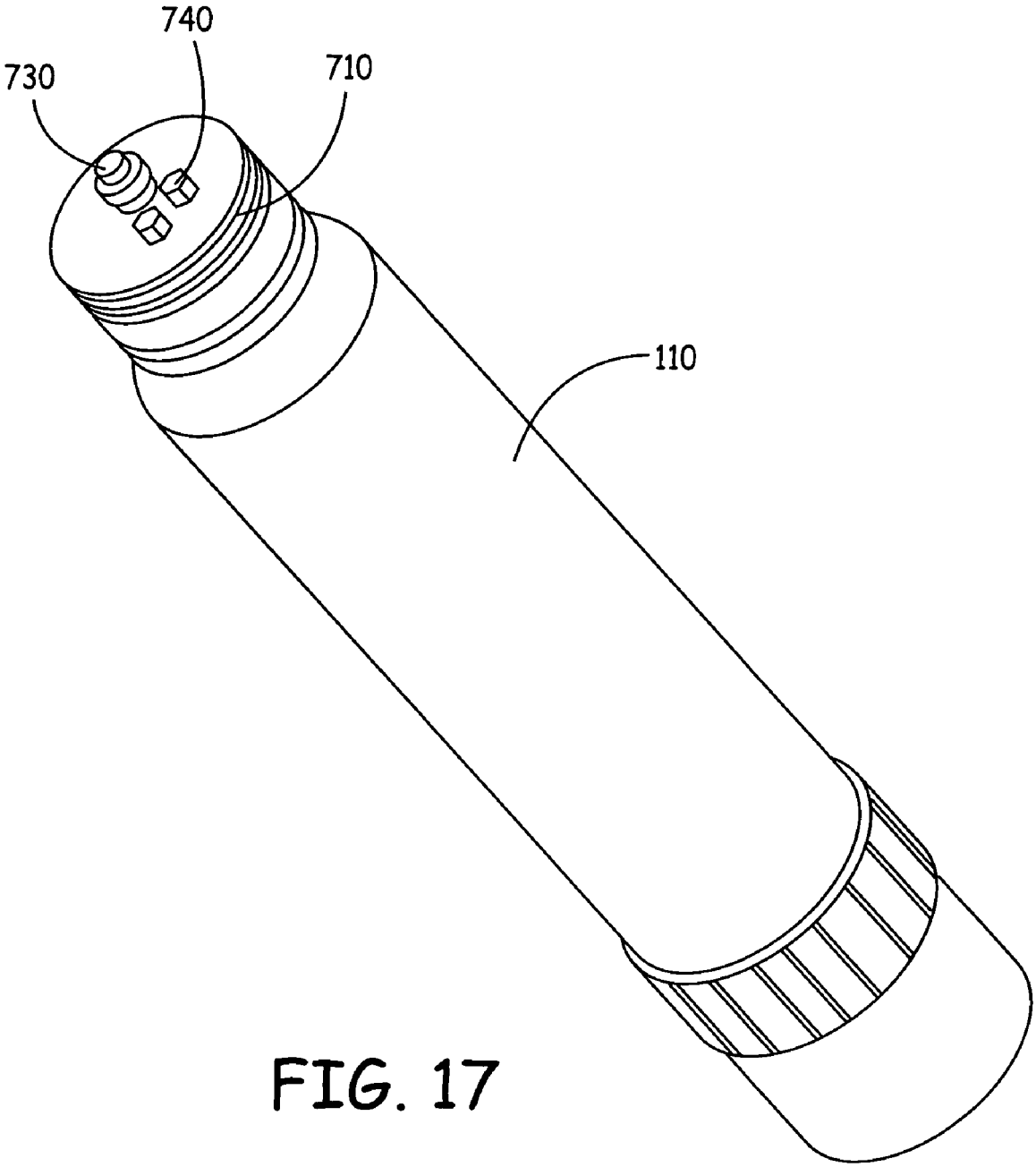
FIG. 17 is a perspective view of an alternate embodiment of the cartridge of the present invention.
Figure 18:
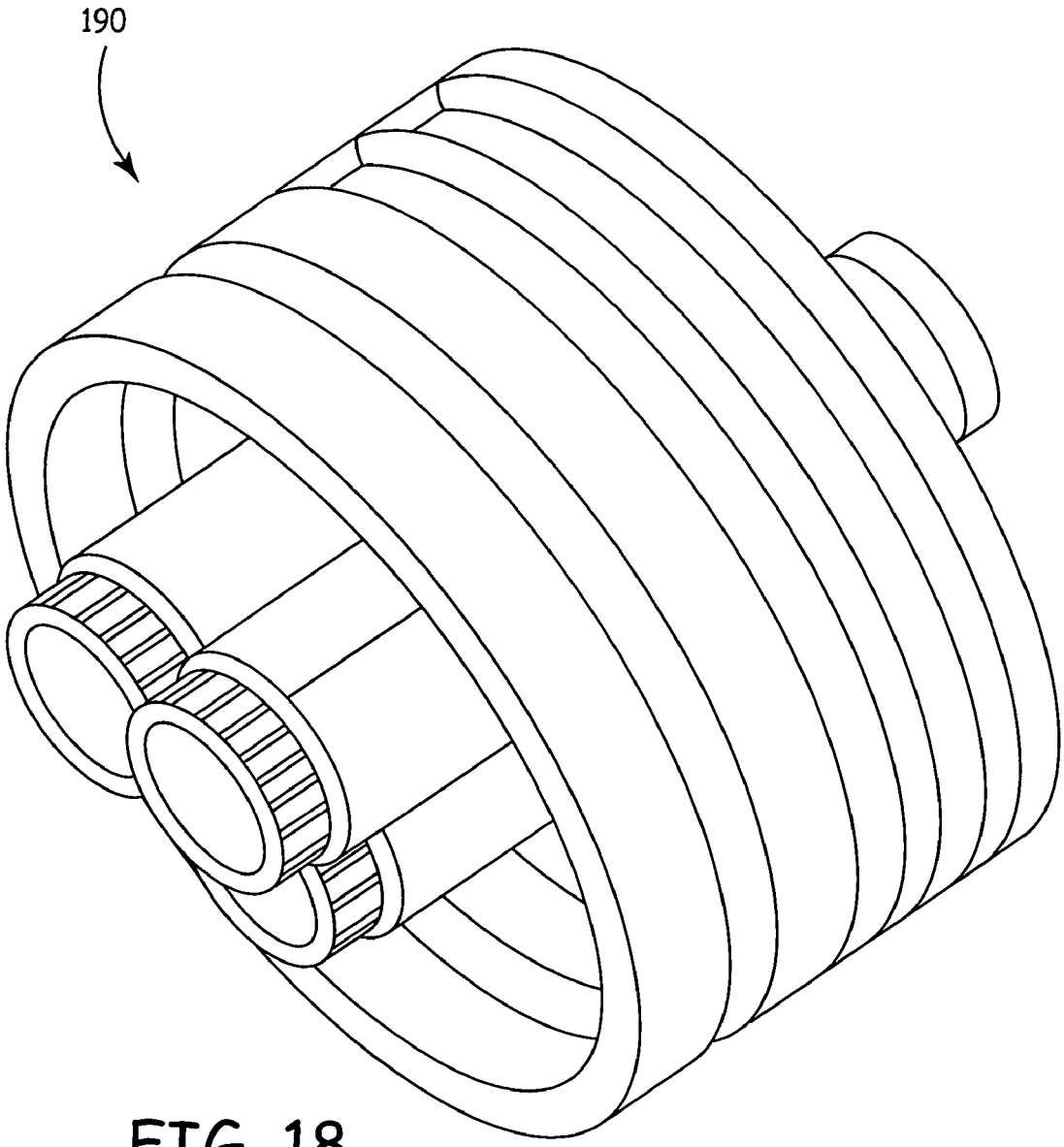
FIG. 18 is a perspective view of one embodiment of the coupling of the present invention.

An alternate embodiment of the cartridge suitable for use in the power sprayer 100 is illustrated in FIG. 17. The cartridge 110 of this embodiment includes a neck 710 having male threads. The housing 120 connects to the cartridge 110 via female threads on the coupling 190, as shown in FIG. 18, adapted to mate with the male threads of the neck 710.

Alternatively, it will be recognized by those in the art that any other known means of attachment, such as a snap-fit mechanism, may be used to attach the cartridge 110 to the coupling 190. In other embodiments, one or more adapters may be provided with the sprayer 100 to facilitate the sprayer's connection to the necks 710 of most, if not all, cartridges 110 or other types of reservoirs, such as the typical off-the-shelf household cleaners, insecticides, fungicides, etc.

As shown in FIG. 15, the cartridge 110, in one embodiment, has an air intake 740 and a fluid outlet 730, whereby air flows into the cartridge 110 through the air intake 740, and the substance to be delivered to the pump expels from the fluid outlet 730. When the cartridge 110 is connected to the housing 120, the discharge outlet 730 is in fluid communication with the first fluid pathway 520.

Figure 20:
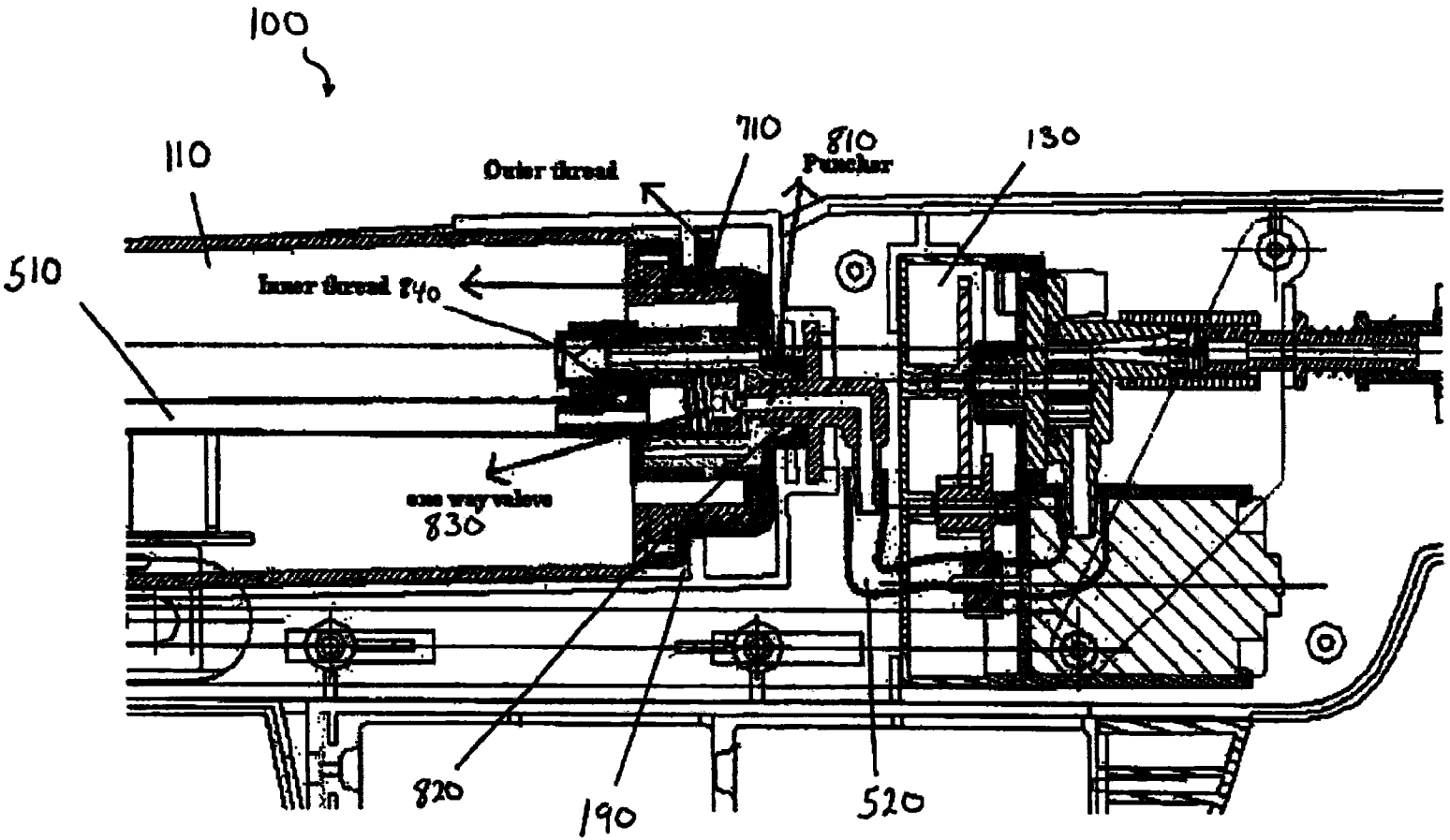
FIG. 20 is a cross section view illustrating the connecting parts for attaching one embodiment of the cartridge to the housing of the present invention.

In a further embodiment of the present invention illustrated in FIG. 20, the coupling 190 includes a puncher 810 at the end of first fluid pathway 520 in fluid communication with the cartridge 110. When the cartridge 110 is attached to the coupling 190, e.g., employing a threaded neck (shown in FIG. 20) or a bayonet-type attachment as previously disclosed, the puncher 810 breaks through seal 820 and contacts a one-way valve 830 in fluid communication with the intake tube 510. Initially, the seal 820 is airtight and preserves the contents of the cartridge 110 before attachment to the coupling 190. In one embodiment of the present invention, the seal 820 can be self closing, wherein the seal 820 reseals itself after detachment from the coupling 190. One skilled in the art will recognize that the seal 280 can be manufactured from any suitable material, such as rubber, silicon, plastic, etc. The one-way valve 830 allows fluid from the intake tube 510 to flow into the first fluid pathway 520 while preventing fluid flow from the first fluid pathway 520 into the intake tube 510.

As illustrated in FIG. 20, the present invention, in one embodiment, may include a one-way air inlet valve 840 coupled to the air intake 740. The air inlet valve 840 allows air to flow into the cartridge 110 while preventing air and/or fluid to flow out of the air intake 740.

In an alternate embodiment, depicted in FIGS. 17 and 18, the coupling 190 is adapted to enable air to flow into the cartridge 110 from a reciprocating manual air pump, as previously described. The cartridge 110/coupler 190 arrangement has at least one mating male/female type air intake 740 to accommodate airflow into the cartridge 110 from the pump 130. At least one fluid outlet 730 is provided to allow the contents of the cartridge 110 to flow out to the pump 130. An appropriate number of intakes 740 and outlets 730, with appropriate characteristics (size, connections, filters, etc.), may be used.

In some embodiments, the cartridge 110 for use in the power sprayer 100 of the present invention is disposable, i.e., designed to be sold full, used by a user, then thrown away when emptied of contents. The cartridges 110 are interchangeable and, in some embodiments, may be made available with various contents. That is, the same style or type of cartridge 110 may be sold with different contents; for example, one cartridge 110 may contain one insecticide and another cartridge 110 can contain a different insecticide, or another type of substance to be dispensed. Thus, the cartridges 110 may be adapted to be interchangeably connected to and removed from the power sprayer 100 for application of selected chemicals or other substances.

In some embodiments, the cartridge 110 and coupling 190 can be connected only one way, thus minimizing the possibility of incorrect or incomplete mounting or attachment of the cartridge 110 and leakage resulting therefrom.

In other embodiments, the present invention can comprise a single use, disposable item wherein a cartridge 110 of material to be dispensed is provided with the power sprayer 100 and, when the cartridge 110 is exhausted, the entire apparatus is disposed of.

Figure 19:
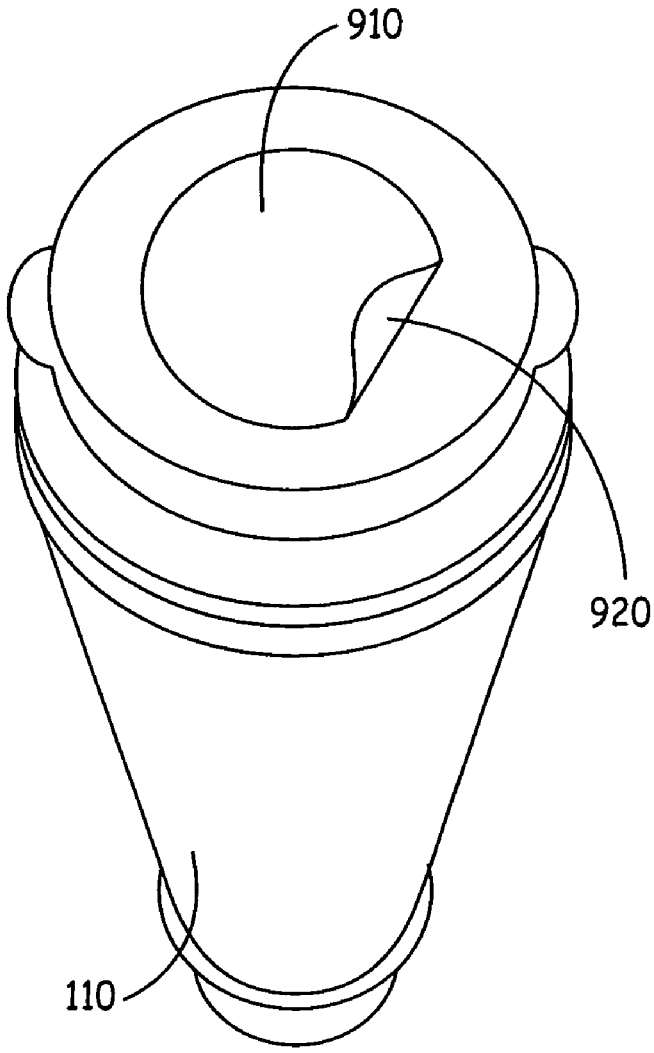
FIG. 19 is top perspective view of one embodiment of the cartridge of the present invention with a foil seal attached.

In a further embodiment of the present invention, the cartridge 110 initially includes a foil seal 910 or cap covering the air intake 740 and/or fluid outlet 730, as illustrated in FIG. 19. The foil seal 910 is removably attached near, or at, the neck 710 of the cartridge 110 and is typically removed before the cartridge 110 is attached to the housing 120. In one embodiment, the foil seal 910 is removed from the cartridge 110 by pulling on a tab 920. The foil seal 910 will generally ensure that the contents of the cartridge 110 stays fresh and/or usable. It should be recognizable to others in the art that any other method of sealing the contents of the cartridge, such as with an airtight cap, may be used as a substitute for the foil seal 910.

Although the present invention has been described with reference to several embodiments, including preferred embodiments, persons skilled in the art will recognize that changes may be made in form and detail without departing from the spirit and scope of the invention. For example, the components which are integrated to form the present invention, including the outer shells 210 and components which contact substances to be dispensed may be made of any suitable material. Polyethylene or stainless steel are other exemplary materials which have good resistance to organic solvents, acids and bases and other chemicals which could be applied using the present invention.

In some embodiments, the power sprayer 100 can comprise an indicator (e.g., audible, visual, etc.) for indicating various operational states including a low fluid level in the cartridge 110, time to replace the cartridge 110, an empty cartridge 110, pressure levels in the cartridge 110, battery power remaining, potential blockage in the conduit system 180 or in the nozzle 170, and the like. In some embodiments, the power sprayer 100 of the present invention can comprise a light or light source, for example an LED, for illuminating a target.

The power sprayer 100 of the present invention may further incorporate a suitable microprocessor control chip or PCB board, whereby the controller may be programmed and/or used to sense, remember, control and regulate functions and operations of a sprayer in accordance with the present invention.

With regard to fastening, mounting, attaching or connecting components of the present invention to form the delivery apparatus as a whole, unless specifically directed otherwise, such are intended to encompass conventional fasteners such as threaded connectors, bayonet-type connective structures, snap rings, detent arrangements, clamps, rivets, pins and the like. Components also may be connected by adhesives, glues, welding, ultrasonic welding, friction fitting or deformation, if appropriate. Appropriate liquid and/or airtight seals or sealing devices may be used. Electronic portions of the apparatus or device may use conventional, commercially available electronic components, connectors and devices such as suitable wiring, connectors, printed circuit boards, micro chips, displays, lights, LED's, liquid crystal displays, pressure sensors, liquid level sensors, inputs, outputs, and the like. Unless specifically otherwise disclosed or taught, materials for making components of the invention may be selected from appropriate materials such as metal, metallic alloys, natural and manmade fibers, vinyls, plastics, and the like. Appropriate manufacturing and production methods including casting, pressing, extruding, molding and machining may be used.

We claim:

1. A delivery device for delivering a stream of fluid or liquid, said device comprising:

a housing;

a container for containing the fluid or liquid releasably connected to the housing by a coupling mechanism, wherein the container includes an opening at one end and a penetrable seal, located at the opening, preserving the contents therein, wherein the container includes an outer wall defining an interior space of the container;

a conduit system operably connected to the container and to a nozzle and comprising a punching mechanism, wherein the punching mechanism penetrates the seal of the container when the container is connected to the coupling mechanism, thereby providing access to the contents therein;

a one-way valve in the container, said valve located adjacent to the opening of the container, said valve located within the interior space of the container, wherein the valve allows fluid to flow in only one direction, the one direction being out of the container;

a pump contained within the housing for forcing the stream of fluid or liquid through the conduit system and out the nozzle;

a motor contained within the housing and operably connected to the pump;

an actuating mechanism for actuating a stream of fluid or liquid; and a structure associated with the conduit system for causing the stream of fluid or liquid to be generally laminar.

2. The device according to claim 1, wherein the penetrable seal is self closing, thereby resealing the opening when the container is detached from the coupling mechanism.

3. The device according to claim 1, wherein the coupling mechanism comprises female threads located in the housing and male threads located at the end of the container containing the opening, wherein the male threads of the container and the female threads of the housing mate to releasably connect the container to the housing.

4. The device according to claim 3, wherein the container further comprises an air intake comprising:

an air intake aperture located near the opening; and a valve, wherein the valve allows air to flow in only one direction, the one direction being into the container.

5. The device according to claim 1 wherein:

the end of the container has a flat end surface.

6. The device according to claim 1 wherein:

the coupling mechanism comprises an axial extension on the end of the container and a recess in a coupling of the housing whereby the axial extension can be aligned with the recess in the coupling and the container can be rotated such that the axial extension is are no longer in alignment with the axial recess of the coupling.

7. The device according to claim 1 further comprising:

a lock having a first position in which the actuating mechanism is prevented from being actuated and a second position in which the actuating mechanism can be actuated.

8. The device according to claim 1 further comprising:

a flexible pick up tube disposed in the container, the pick up tube being in fluid communication with the one-way valve; and a weight at an end of the pick up tube.

* * * * *